United States Patent [19]

Miller

[11] 3,936,892

[45] Feb. 10, 1976

[54] MULTI PURPOSE CLEAN-OUT ATTACHMENT

[76] Inventor: Fredrick A. Miller, 2400 El Camino Real, Mountain View, Calif. 94040

[22] Filed: Sept. 26, 1974

[21] Appl. No.: 509,414

[52] U.S. Cl. ..... 4/255; 4/256

[51] Int. Cl.[2] ..... E03D 11/00

[58] Field of Search ..... 4/255, 256, 191, 257, 262

[56] References Cited

UNITED STATES PATENTS

| | | | |
|---|---|---|---|
| 831,722 | 9/1906 | Holmes | 4/256 |
| 1,885,977 | 11/1932 | Denison | 4/256 X |
| 1,938,064 | 12/1933 | Carmine | 4/256 X |
| 2,766,841 | 10/1956 | King | 4/255 |
| 3,526,547 | 9/1970 | Shock | 4/256 X |

*Primary Examiner*—Henry K. Artis
*Attorney, Agent, or Firm*—Limbach, Limbach & Sutton

[57] ABSTRACT

A plumbing fitting that is adaptable to be installed along any drain line so to permit the drain line to be easily and readily cleaned out in case it becomes clogged; the device consisting of a length of pipe having an internal screw thread at one end and an external screw thread at an opposite end for easy connection along the drain line, the length of pipe having a branch line extending from a side thereof and which is adaptable for receiving a clean-out rod or which may be attached to a hose, and a shut off valve cock being located along the main pipe so as to prevent back pressure up into a plumbing fixture such as a sink, tub or toilet.

2 Claims, 3 Drawing Figures

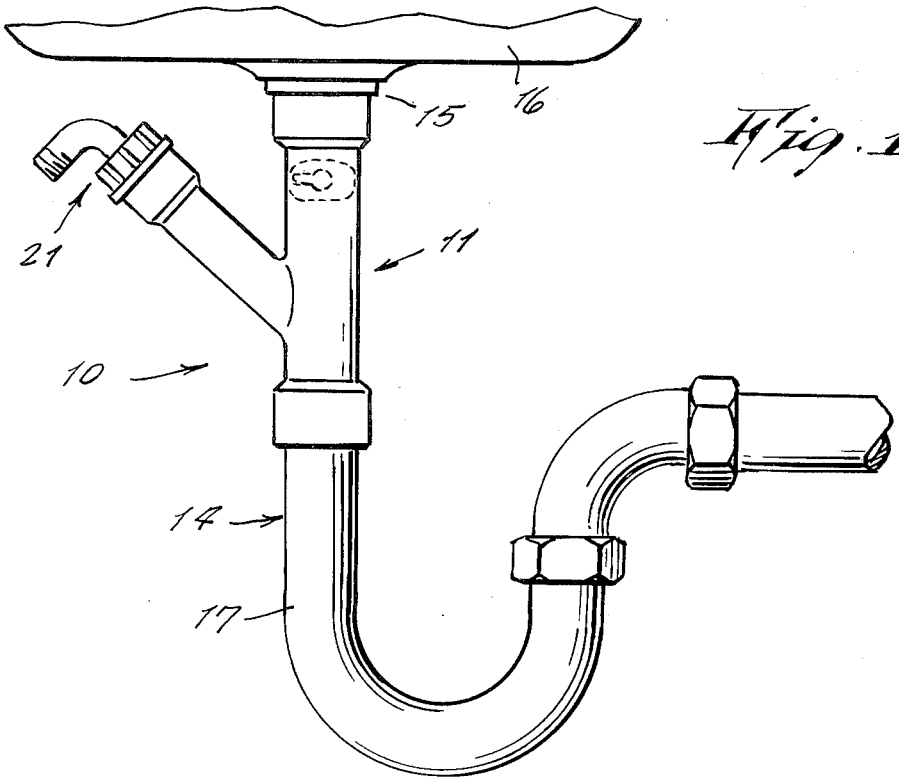
Fig. 1
Fig. 2
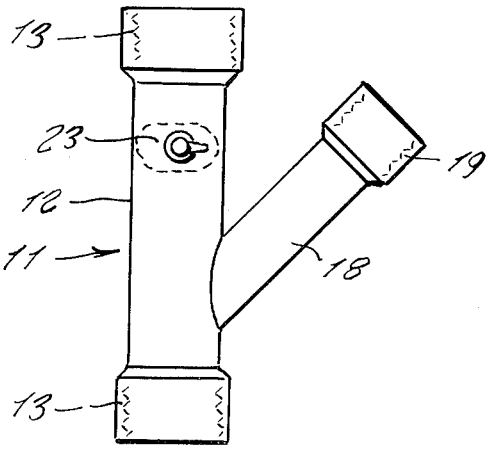
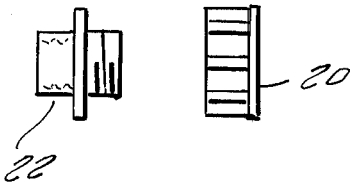
Fig. 3
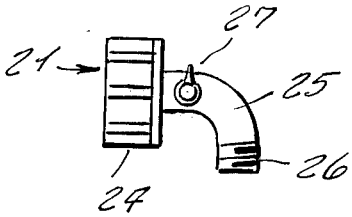

MULTI PURPOSE CLEAN-OUT ATTACHMENT

This invention relates generally to plumbing fixtures.

A principal object of the present invention is to provide a multi purpose clean-out attachment that makes it very easy to clean out a clogged drain line.

Another object of the present invention is to provide a multi purpose clean-out attachment which can be installed anywhere along a drain line so that it is always ready for use without the additional work of installing each time it is needed.

Still another object of the present invention is to provide a multi purpose clean-out device attachment which can be made in any size so that it is adaptable for all plumbing of a house.

Other objects of the present invention are to provide a multi purpose clean-out attachment which is simple in design, inexpensive to manufacture, rugged in construction, easy to use and efficient in operation.

These and other objects will be readily evident upon a study of the following specification and the accompanying drawing, wherein:

FIG. 1 is a side elevation view of the present invention shown installed in a plumbing drain system.

FIG. 2 is a side elevation view thereof showing the main fitting, and adapter and an end cap.

FIG. 3 is side elevation view of a modified design of end cap which incorporates a hose connection and a shut off valve cock.

Referring now to the drawing in detail, the reference numeral 10 represents a multi purpose clean-out attachment according to the present invention wherein there is a main fitting 11 that includes a straight length of pipe 12 which at its opposite ends can be provided with any suitable form of screw thread 13 that may be internal or external in order that it may be readily installed within a drain system 14 as shown in FIG. 1 wherein the same is installed between a drain plug 15 of a sink 16 and a trap 17.

The fitting 11 actually is a Y-fitting by incorporating an angularly sidewardly extending branch line 18, the outer end of which includes some form of screw thread 19 in order that the same may be readily engageable with either an end cap 20, a special end cap 21 or else with an adaptor 22.

As shown in FIG. 2, it is to be noted that a shut off valve cock 23 is installed along the pipe 12 of fitting 11 and is located in a position so to close communication between a sink 16 or other plumbing fixture from the rest of the drain system.

As shown in FIG. 3, the special end cap 21 includes an end cap 24 to which a small diameter pipe 25 is securely attached, one end of the pipe 25 including screw thread 26 so that it is attachable to a conventional garden hose. Additionally the pipe 25 includes a shut off valve cock 27.

In operative use, it is now evident that in case of a clogged drain system, the end cap 20 may be removed from the end branch line pipe 18 so that a clean-out rod or snake can be pushed down therein and down into the drain so to dislodge the clogged material. Alternately, the special end cap 21 can be threadingly engaged upon the end of the branch line pipe 18 and a garden hose can be attached to the threaded end 26 of pipe 25. At such time the valve cock 23 is closed and the valve cock 27 is opened so that the pressure of the water can be forced downwardly into the drain system so to force the clogged material ahead into a drain sewer. The valve cock 23 must necessarily be closed at such time in order that there is no back into the sink 16 or other plumbing fixture such as a tub or toilet. In situations wherein a different size of hose is intended to be connected to the branch line pipe 18, the adaptor 22 may be used which includes different types of screw threads at each opposite end thereof.

Thus there is provided a multi purpose clean-out attachment.

While various changes may be made in the detail construction, it is understood that such changes will be within the spirit and scope of the present invention as is defined by the appended claims.

What I claim is:

1. A multi purpose clean-out attachment for a drain system comprising a fitting having a length of pipe with means at opposite ends thereof for connection to the drain system and a branch line pipe composite therewith and angularly disposed one end thereof to said length of pipe at an acute angle with one end of said length of pipe and having means at the free end of said branch pipe remote from said length of pipe for connection to a garden hose, a first integrally mounted manually controllable valve cock with the valve portion mounted within said one end of said length of pipe, and a second integrally mounted manually controllable valve cock with the valve portion mounted within said free end of said branch pipe whereby a drain system in which said clean-out attachment is connected can be cleaned out by closing said first valve cock, opening said second valve cock and directing water through said branch pipe from a garden hose into the length of pipe.

2. In a clean-out system the combination of a drain plug of a sink; a trap; a fitting having a length of pipe with means at one end for connection to said drain plug and means at the opposite end for connection to said trap and a branch line pipe composite therewith and angularly disposed sideward at one end thereof to said length of pipe at an acute angle to said one end of said length of pipe and having means at the free end of said branch pipe remote from the length of pipe for connection to a garden hose, a first integrally mounted manually controllable valve cock with the valve portion mounted within said one end of said length of pipe, and a second integrally mounted manually controllable valve cock with the valve portion mounted within said free end of said branch pipe whereby said trap can be cleaned out by closing said first valve cock, opening said second valve cock and directing water from a garden hose through said branch pipe into said length of pipe and through said trap in a direction away from said drain plug.

* * * * *